US005933879A

United States Patent [19]

Wooldridge et al.

[11] Patent Number: 5,933,879

[45] Date of Patent: Aug. 10, 1999

[54] DUAL FLUSH CISTERN BUTTON ARRANGEMENT

[75] Inventors: Colin William Wooldridge, Modbury; Terry Hall, Dulwich, both of Australia

[73] Assignee: Caroma Industries Limited, Brisbane, Australia

[21] Appl. No.: 08/779,732

[22] Filed: Jan. 6, 1997

[30] Foreign Application Priority Data

Jan. 9, 1996 [AU] Australia ..... PN 7493

[51] Int. Cl.[6] ..... E03D 5/09

[52] U.S. Cl. ..... 4/410

[58] Field of Search ..... 4/326, 327, 410

[56] References Cited

U.S. PATENT DOCUMENTS

D. 269,202 5/1983 Thompson .

5,502,846 4/1996 Chelchowski et al. ..... 4/410 X

FOREIGN PATENT DOCUMENTS

| | | | |
|---|---|---|---|
| 0648572 | 2/1993 | Australia | 4/410 |
| 117006 | 5/1993 | Australia . | |
| 78 12444 | 4/1978 | France . | |
| 2662723 | 12/1991 | France | 4/410 |
| 26563 | 11/1995 | New Zealand . | |

*Primary Examiner*—Charles E. Phillips
*Attorney, Agent, or Firm*—Merchant, Gould, Smith, Edell, Welter & Schmidt, P.A.

[57] ABSTRACT

Operating buttons (2, 3; 102, 103; and 202, 203) for a dual flush cistern or flush tank include different operating surface area of each button presented to the user and provide an indication as to which button provides the reduced flush and which button provides the full flush. A hinge and latch assembly is used to fabricate such buttons (2, 3) by folding from a moulded form into an operational form.

13 Claims, 8 Drawing Sheets

DUAL FLUSH CISTERN BUTTON ARRANGEMENT

The present invention relates to the operating buttons of a cistern (or flush tank as the devices are known in the U.S.A.).

BACKGROUND ART

In particular, dual flush cisterns have been known for many years and are normally provided with dual flush buttons. The operation of one of these buttons generates a reduced volume flush intended to be used if the lavatory pan to be flushed by the cistern contains urine only, and a full flush to be used otherwise—which is generated by operation of the other button. These buttons are therefore known as reduced flush and full flush buttons respectively.

Hitherto, such buttons have been of essentially the same size and shape and U.S. Design No. 269,202 and Australian Registered Design No. 117,006 illustrate typical examples of this prior art.

There is a sound economic reason for making the two buttons identical in size and shape. This is because a single product is therefore able to be utilised for both buttons. This reduces the cost of preparing moulds and also reduces the cost of inventory for spare parts.

In order to indicate to the user of the toilet which of the buttons operates the full flush and the reduced flush respectively, some form of indicium is normally adhered to the upper surface of the button which constitutes the surface of the button pushed by the user. Normally such indicia take the form of, for example, a full circle to indicate a full flush and a semi-circle to indicate a reduced flush.

One problem with such indicia is that they are not easily able to be seen by persons with imperfect or impaired eyesight. Another problem, for those cisterns located in areas of high usage, is that the indicia may become worn through use, and therefore not constitute a reliable indication to subsequent users. Further, the indicium bearing surface may be damaged by cigarette burns or like acts of carelessness or vandalism.

SUMMARY OF THE INVENTION

In order to substantially overcome or ameliorate the above mentioned difficulties, the object of the present invention is to provide an alternative means of indicating which of the two buttons is the reduced flush button and the full flush button respectively.

In accordance with the present invention there is disclosed a dual flush button arrangement having a full flush button and a reduced flush button, said arrangement being for use with a dual flush cistern having a full flush and reduced flush actuatable by a user on operation of said full flush button and said reduced flush button respectively, wherein each of said buttons has an operating surface area presented to said user and the operating surface area of said reduced flush button is substantially less than the operating surface area of said full flush button.

Preferably the buttons are arranged immediately adjacent each other. The adjacent buttons are also preferably of a mutually complementary shapes so that the adjacent buttons together form a visually pleasing whole. Preferably the ratio of the operating surface areas of the buttons is approximately equal to the ratio of the volume of the flushes.

BRIEF DESCRIPTION OF THE DRAWINGS

Three embodiments of the present invention will now be described with reference to the drawings in which.

DESCRIPTION OF THE PRIOR ART

Figure 1:
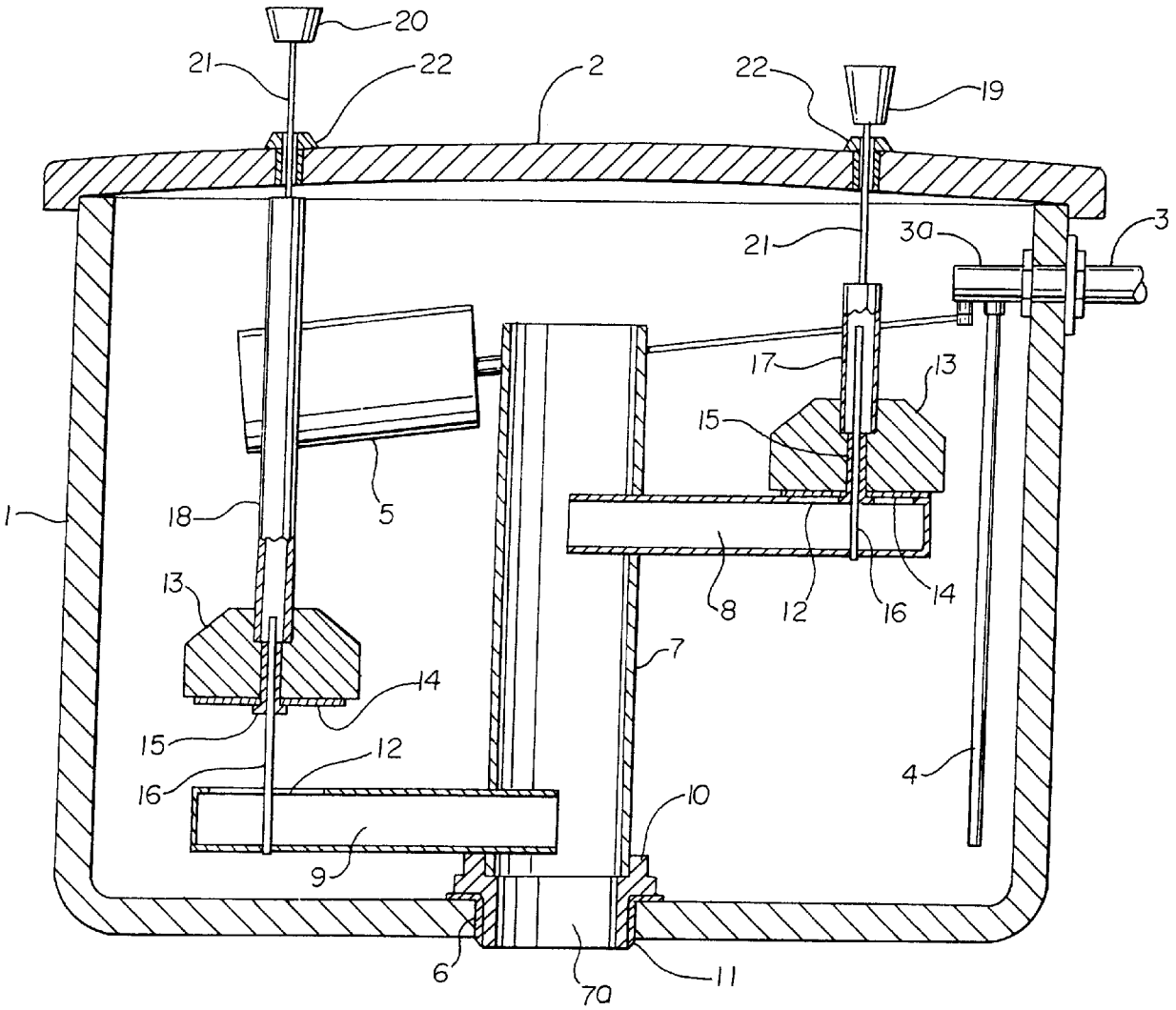
Fig. 1 PRIOR ART
FIG. 1. is a reproduction of the single drawing of prior art French Patent No. 2,423,594 (Application No. 78 12444) to A. Kerlo.
Figure 2:
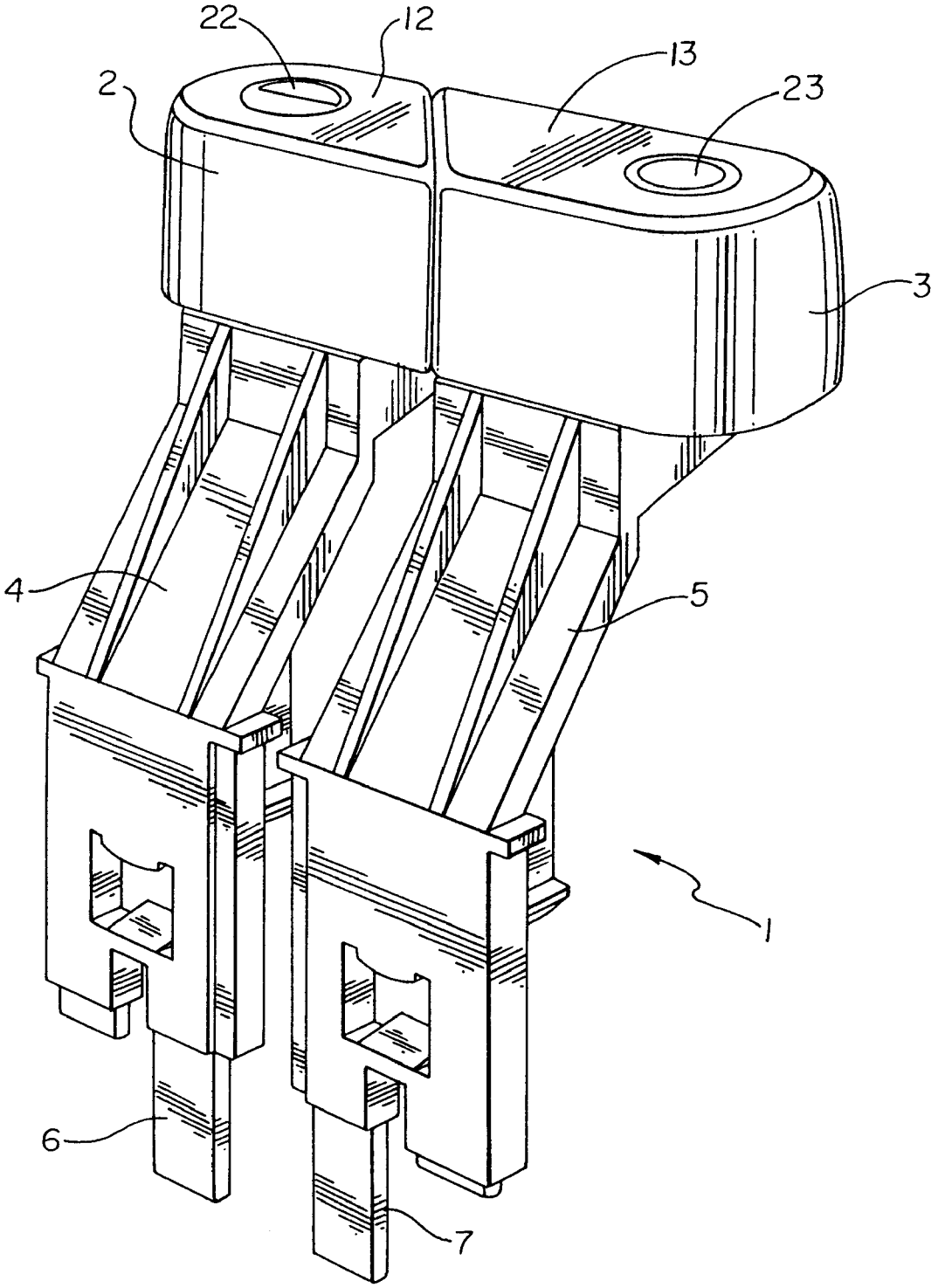
FIG. 2 is a perspective view of the set of dual flush buttons of the preferred embodiment, arranged in their intended operating position (the lid of the cistern being omitted for clarity)

Prior art searches conducted after the priority date have revealed French Patent No. 2,423,594 based on Application No. 78 12444 in the name of A. Kerlo which discloses a dual flush cistern arrangement. The single drawing of the French specification is reproduced as FIG. 1 of this specification for the convenience of the reader.

In the French specification, two frusto-conical buttons 19 and 20 which actuate the cistern are disclosed. In the description as translated into English the following appears:

"Each pull member is provided with a button 19 or 20, with 19 being smaller than the other 20 to identify the pull member corresponding to the smaller water volume obtained upon its actuation.

These buttons are connected to the hollow tubes 16 or 17 through the shafts 21 which run through the cover 2 in openings provided with a rubber collar or plastic collar 22.

When the user decides to discharge the minimum amount of water, he pulls the smaller button 19; this raises the shaft 16, its valve flap 13 uncovers the opening 12 of the first spout 8, the third of the water volume situated above the latter passes there and is discharged via the duct 7 into the receiving bowl. Water fills the cistern again and its float 6 swings upwards as soon as the level has been reached; the full amount can be discharged through duct 7 the height of which remains free.

The operation proceeds in the same way when the user decides to actuate button 20, but the amount of water discharged into the spout 9 corresponds to almost the full volume of the water flush.

In an other embodiment one can contemplate coaxial pull members situated so that their exit from the cover plate is in a central or off-centre position.

In an other embodiment, the pull members can be on the side of the cistern, one on each side."

The above description is not consistent with the drawing (FIG. 1) since as drawn both button 19 and 20 have the same upper diameter but button 19 is longer in vertical extent than button 20. Thus button 19 is not "smaller" than button 20 as stated but is, in fact, larger.

Although button 20 is illustrated in the raised position, and button 19 is illustrated in the rest (or lowered) position, the arrangement illustrated seems to indicate that when both buttons 29 and 20 are in the rest position, the upper surfaces of the buttons are of approximately equal height.

This presents a problem for the user in that the cistern (or flush tank) 1 is mounted just above the lavatory pan (not illustrated) and is therefore at or below waist height for the adult user. Also the cistern is actuated when the user is standing and facing the cistern. From this position the user essentially only sees the upper surfaces of the buttons 19 and 20 and thus has great difficulty in discerning any difference in size between the buttons 19 and 20. Thus the buttons 19 and 20 do not actually identify the corresponding volume of flushing water or distinguish one button from the other.

Finally, the French specification suggests two further embodiments, one with coaxial pull members, the other with pull members located one on each opposite side of the cistern. There is no explanation in relation to either of these proposed embodiments as to how the corresponding buttons might indicate by their construction as to which button operates the full flush and which button operates the half flush.

DETAILED DESCRIPTION

As seen in FIGS. 2 to 10 of the drawings, the set 1 of buttons of the preferred embodiment takes the form of a reduced flush button 2 and a full flush button 3 which each have a supporting stem 4,5 and an actuator 6,7. Each of the buttons 2,3 has an operating surface 12,13 which is presented to the user and which includes one of two indicia 22,23 respectively.

Figure 3:
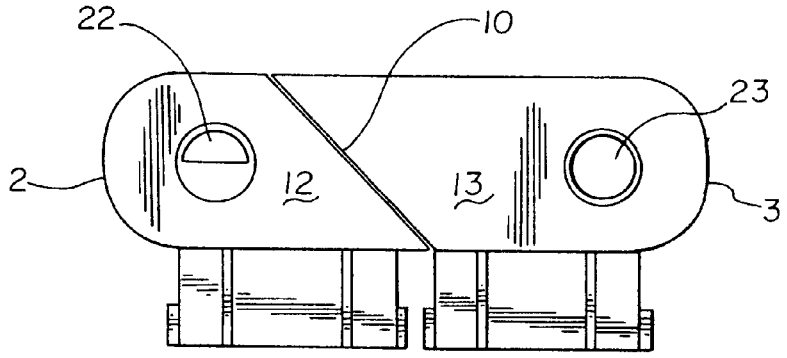
FIG. 3 is a plan view of the buttons of FIG. 2.
Figure 4:
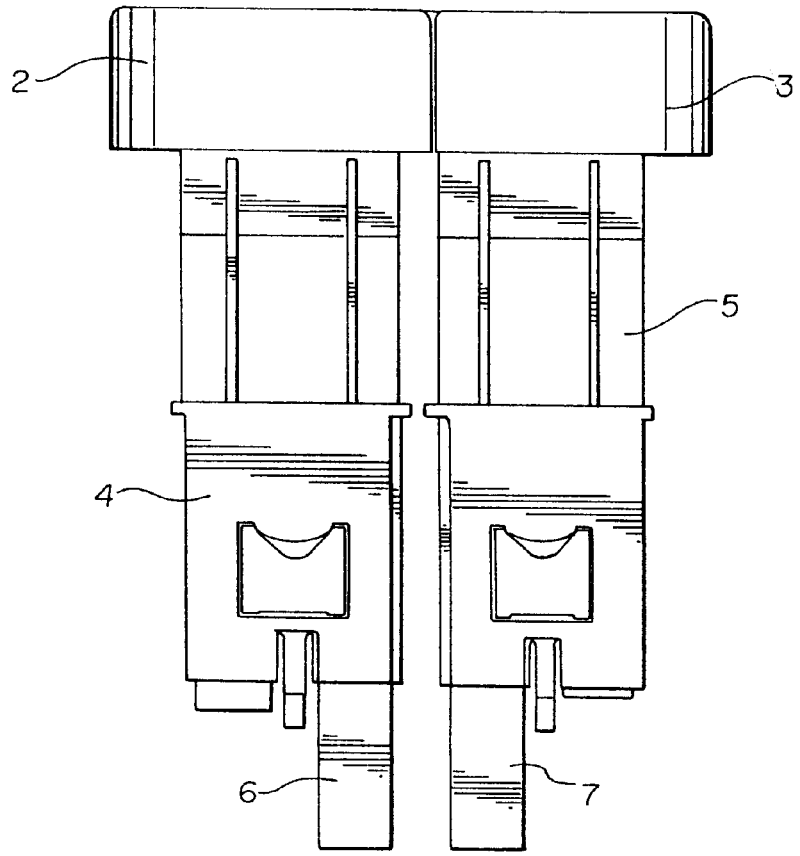
FIG. 4 is front view of the buttons of FIG. 2.
Figure 5:
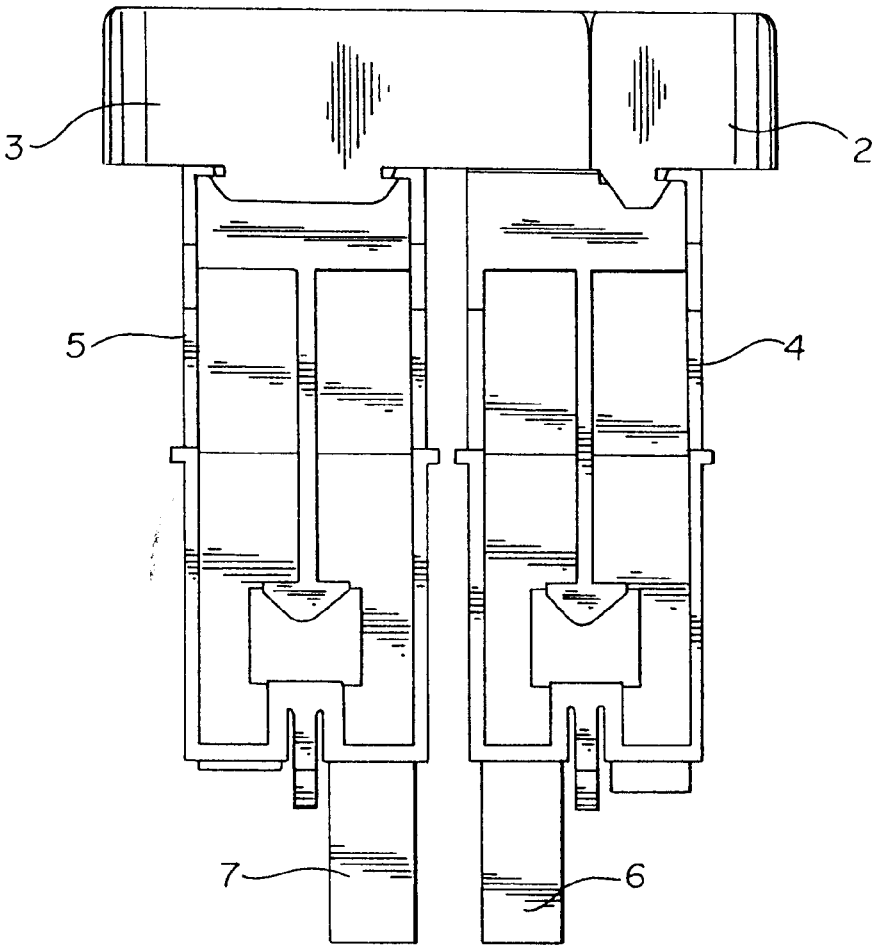
FIG. 5 is a rear view of the buttons of FIG. 2.
Figure 6:
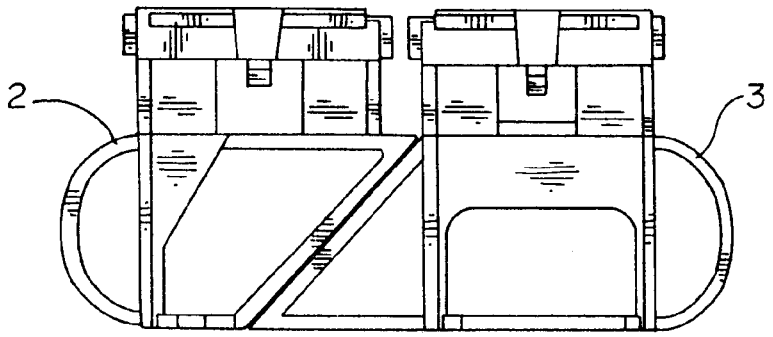
FIG. 6 is an inverted plan view of the buttons of FIG. 2.
Figure 7:
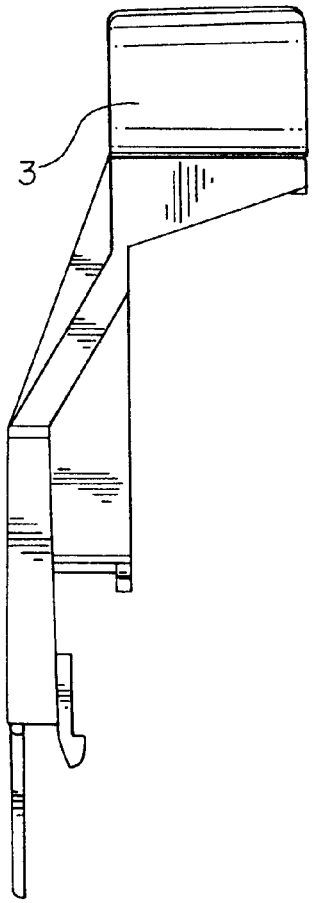
FIGS. 7 and 8 are respectively a right and a left side elevation of the buttons of FIG. 2.
Figure 8:
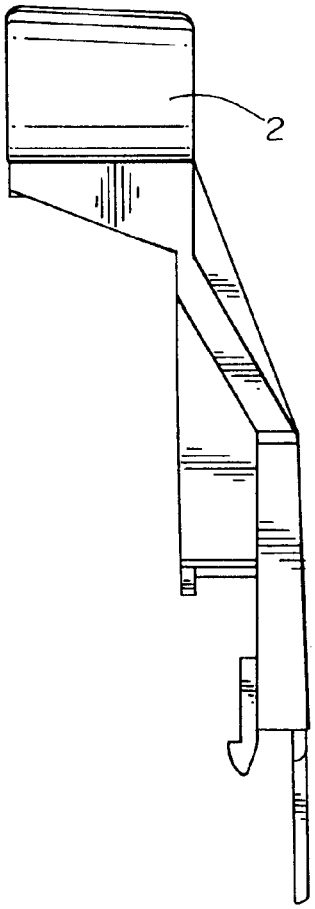

As best seen in FIG. 3, the buttons 2,3 are located immediately adjacent each other and have a complementary shape so that together the two buttons 2,3 form a substantially oval shape which appears to be divided by means of a diagonal slash 10. Since it is intended that the full flush should be approximately six liters, and the reduced flush should be approximately three liters, it will also be apparent from FIG. 3 that the ratio of the operating surfaces 12,13 is approximately the same as the ratio (3:6) of the respective flushes. As a consequence, even if the indicia 22,23 should become obliterated through heavy use, damage or the like, it is still immediately apparent to the user that the button 2 having the smaller operating surface 12 actuates the reduced flush, whilst the button 3 having the larger operating surface 13 operates the full flush.

Further, as best seen in FIG. 3 where the buttons 2,3 are in their rest position, the operating surfaces 12,13 are substantially flush with each other. Preferably these surfaces 12,13 will be substantially flush with the lid of the cistern (both not illustrated).

Figure 9:
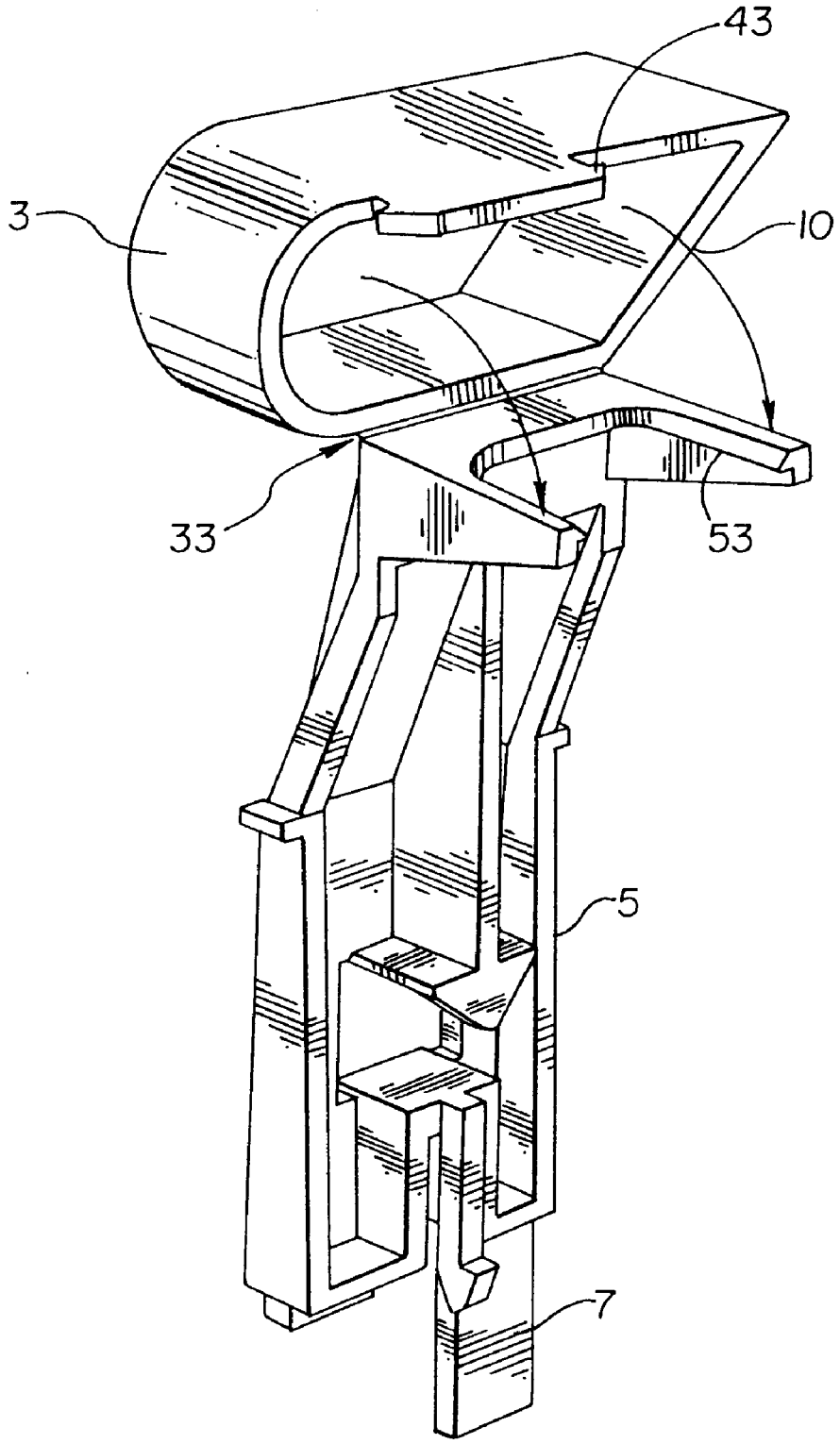
FIG. 9 is a perspective view from the rear of the full flush button prior to its being folded into its final position.
Figure 10:
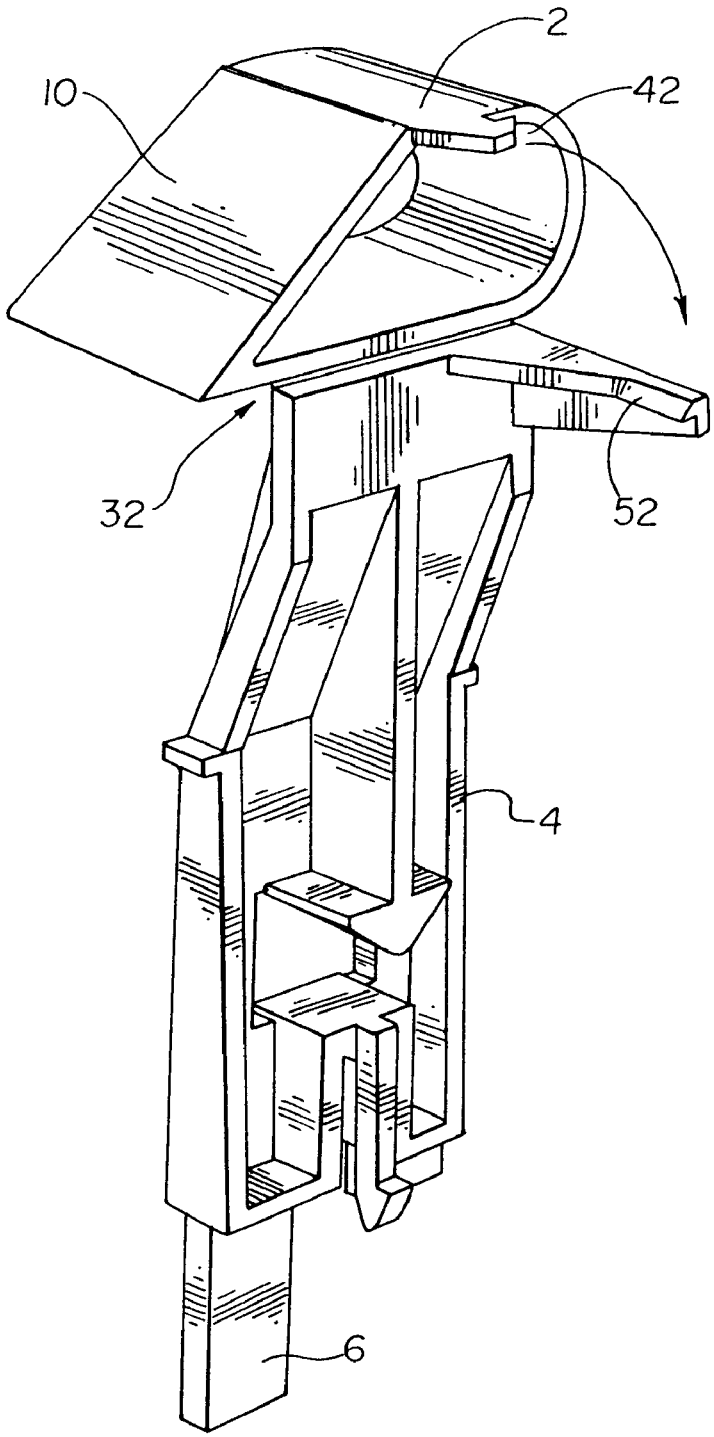
FIG. 10 is a similar view to that of FIG. 9 but of the reduced flush button.

Turning now to FIGS. 9 and 10, it will be apparent that in order to assist the production of the set of buttons by means of injection moulding, it is desirable that the buttons 2,3 be moulded at an angle of approximately 90° relative to their final operating position. This is achieved by moulding hinges 32,33 between the buttons 2,3 and the supporting stems 4,5 respectively. Each of the buttons 2,3 is also provided with a latch mechanism 42,43 which is snap-engageable with a lip 52 and a pair of lips 53 respectively.

Figure 11:
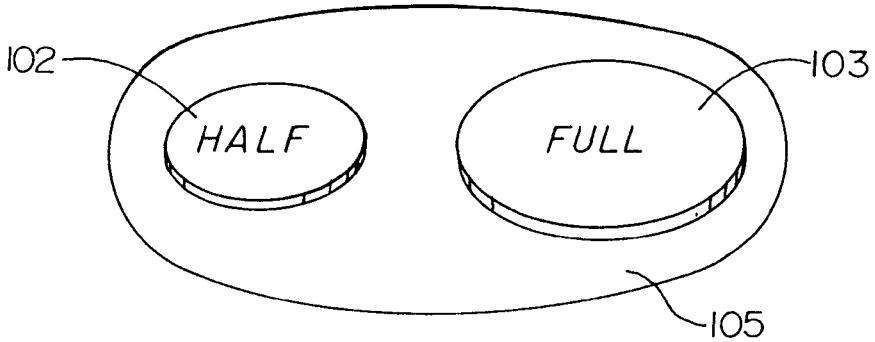
FIG. 11 is a plan view of a second embodiment.

As seen in FIG. 11, a second embodiment of the present invention is illustrated. Here the two buttons 102 and 103 respectively are circular or cylindrical in form and are mounted within a quasi-elliptical surround 105. The indicia "HALF" and "FULL" are used to indicate the reduced flush button 102 and full flush button 103 respectively in addition to the indication provided by the different apparent areas of the buttons 102, 103.

Figure 12:
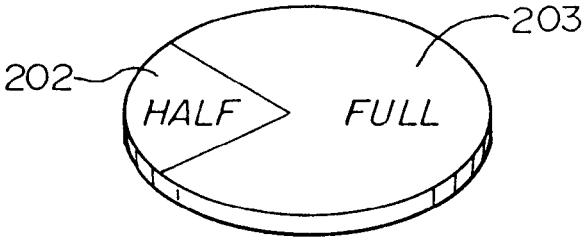
FIG. 12 is a plan view of a third embodiment.

A third embodiment is illustrated in FIG. 12. Here the two buttons 202, 203 respectively take the form of complementary sectors of the same circle or cylinder. Again the additional indicia "HALF" and "FULL" are provided.

The foregoing describes only three embodiments of the present invention and modifications, obvious to those skilled in the art, can be made thereto without departing from the scope of the invention. For example, alternative arrangements encapsulating the inventive idea described in the above mentioned preferred embodiment will be apparent to those skilled in the art.

We claim:

1. A dual flush button arrangement having a full flush button and a reduced flush button, said arrangement being for use with a dual flush cistern having a full flush and a reduced flush actuatable by a user on operation of said full flush button and said reduced flush button respectively, wherein each of said buttons has an operating surface area presented to said user and the operating surface area of said reduced flush button is substantially less than the operating surface area of said full flush button and said reduced flush button and said full flush button are of mutual complementary shapes which together form a whole shape; and wherein said buttons are fabricated by molding and are molded out of a final operating position relative to supporting stems and are connected thereto by integrally molded hinges.

2. An arrangement as claimed in claim 1 wherein said reduced flush button and said full flush button are arranged immediately adjacent each other.

3. An arrangement as claimed in claim 1, wherein an integrally molded latch mechanism retains said hinged buttons in said final operating position.

4. An arrangement as claimed in claim 1 wherein said whole shape is substantially an oval and said complementary shapes are formed by a diagonal slash.

5. An arrangement as claimed in claim 1 wherein said whole shape is a circle and said complementary shapes are sectors of said circle.

6. An arrangement as claimed in claim 1 wherein the ratio of the areas of said operating surface areas is substantially equal to the ratio of the volume of the corresponding flushes.

7. An arrangement as claimed in claim 1 wherein each said button is provided with an indicium to indicate the size of the volume of the corresponding flush, the indicia being in addition to the indication provided by the operating surface areas of said buttons.

8. An arrangement as claimed in claim 1 wherein the operating surface areas of said buttons presented to said user are substantially flush when said buttons are both in a rest position.

9. A dual flush button arrangement having a full flush button and a reduced flush button, said arrangement being for use with a dual flush cistern having a full flush and a reduced flush actuatable by a user on operation of said full flush button and said reduced flush button respectively, wherein each of said buttons has an operating surface area presented to said user and the operating surface area of said reduced flush button is substantially less than the operating surface area of said full flush button and wherein the operating surface areas of said buttons presented to said user are substantially flush when said buttons are both in a rest position; and wherein said buttons are fabricated by molding and are molded out of a final operating position relative to supporting stems and are connected thereto by integrally molded hinges.

10. An arrangement as claimed in claim 9, wherein an integrally molded latch mechanism retains said hinged buttons in said final operating position.

11. An arrangement as claimed in claim 9 wherein each said button is provided with an indicium to indicate a size of volume of the corresponding flush, the indicia being in addition to an indication provided by the operating surface areas of said buttons.

12. An arrangement as claimed in claim 9 wherein said reduced flush button and said full flush button are arranged immediately adjacent each other.

13. An arrangement as claimed in claim 9 wherein a ratio of areas of said operating surface areas is substantially equal to a ratio of volume of the corresponding flushes.

* * * * *